United States Patent [19]

Van Der Burgt

[11] Patent Number: 4,809,624

[45] Date of Patent: Mar. 7, 1989

[54] METHOD FOR STARTING UP A PARTIAL COMBUSTION PROCESS

[75] Inventor: Maarten J. Van Der Burgt, The Hague, Netherlands

[73] Assignee: Shell Oil Company, Houston, Tex.

[21] Appl. No.: 165,053

[22] Filed: Mar. 7, 1988

[30] Foreign Application Priority Data

Mar. 16, 1987 [GB] United Kingdom ..... 8706135

[51] Int. Cl.[4] ..... F23D 1/00

[52] U.S. Cl. ..... 110/347; 110/263; 431/6

[58] Field of Search ..... 110/260, 261, 262, 263, 110/264, 265, 347, 106; 431/6

[56] References Cited

U.S. PATENT DOCUMENTS

| | | | |
|---|---|---|---|
| 4,147,116 | 4/1979 | Graybill | 110/263 |
| 4,173,189 | 11/1979 | Cooper | 110/106 |
| 4,353,712 | 10/1982 | Marion et al. | 431/6 X |
| 4,367,686 | 1/1983 | Adrian | 110/347 |
| 4,438,707 | 3/1984 | Delaplace et al. | 110/347 X |
| 4,466,363 | 8/1984 | Leikert et al. | 110/347 |
| 4,474,120 | 10/1984 | Adrian et al. | 110/347 X |
| 4,552,076 | 11/1985 | McCartney | 110/347 |
| 4,690,075 | 9/1987 | Vidal et al. | 110/347 X |

FOREIGN PATENT DOCUMENTS

| | | | |
|---|---|---|---|
| 0155120 | 9/1985 | European Pat. Off. . | |
| 197708 | 7/1977 | U.S.S.R. | 110/347 |

*Primary Examiner*—Steven E. Warner

*Attorney, Agent, or Firm*—Ronald R. Reper

[57] ABSTRACT

A method for starting up a partial combustion process, using a burner, wherein finely divided carbon-containing fuel is supplied to a reactor or gasifier and an oxygen-containing gas is supplied separately from the said fuel to the reactor or gasifier and is mixed with the said fuel adjacent the outlet of the burner in the reactor or gasifier. During a predetermined period a low rank particulate carbon-containing fuel is supplied to the reactor prior to the start of the partial combustion process, said low rank fuel spontaneously reacting with oxygen when brought into contact with the said oxygen-containing gas and subsequently switching the burner to a less reactive finedly divided carbon-containing fuel.

6 Claims, No Drawings

METHOD FOR STARTING UP A PARTIAL COMBUSTION PROCESS

BACKGROUND OF THE INVENTION

The invention relates to a method for starting up a partial combustion or gasification process using a burner wherein finely divided carbon-containing fuel is supplied to a reactor or gasifier and an oxygen-containing gas is supplied separately from the said fuel to a reaction zone comprising a reactor or gasifier and is mixed with the said fuel adjacent the outlet of the burner in the reactor or gasifier. In particular, such gasification processes are used for preparing synthesis gas.

Synthesis gas, consisting mainly of carbon monoxide and hydrogen, is produced by partial combustion of finely divided fuel with a substoichiometric amount of a combustion medium like pure oxygen or an oxygen-containing gas such as air. Depending on the composition of the combustion medium the synthesis gas may also contain other substances, which may be useful or may be considered pollutants.

In gasification processes, usually fuel in a finely divided state is passed with a carrier gas to a reactor zone via a burner, while the combustion medium is either added to the fuel flow inside the burner or separately introduced into said reactor zone. Great care must be taken that the reactants are effectively mixed with each other. If the reactants are not brought into intimate contact with each other, the oxygen and fuel flow will follow at least partially independent paths inside the reactor. Since the reactor zone is filled with mainly hot carbon monoxide and hydrogen, the oxygen will rapidly react with these gases instead of with the fuel. The so formed very hot combustion products carbon dioxide and steam will also follow independent paths having poor contact with the relatively cold fuel flow. This behaviour of the oxygen will result in local hot spots in the reactor, thereby possibly causing damage to the reactor refractory lining and increased heat fluxes to the burner(s) applied.

Sufficient mixing of the fuel and the oxygen can be achieved by adding the oxygen to the fuel flow in the burner itself. A disadvantage of this method is that, in particular at high pressure gasification, the design and operation of the burner are highly critical. The reason for this is that the time elapsing between the moment of mixing and the moment the fuel/oxygen mixture enters into the reactor should be invariably shorter than the combustion induction time of the mixture, to prevent premature combustion inside the burner.

Moreover, the velocity of the mixture inside the burner should be higher than the flame propagation velocity in order to prevent flashback. However, the combustion induction time shortens and the flame propagation velocity increases at a rise in gasification pressure. Further, if the burner is operated at a low fuel load, the combustion induction time or flashback condition might easily be reached in the burner itself, resulting in overheating and possibly damage to the burner.

The problems of premature combustion in the burner itself or flashback will not occur if the fuel and the oxygen are mixed outside the burner in the reactor space itself.

In order to start the gasification process, a separate start-up (ignition) burner is used to ignite the gasification process. Usually, oil- or gasfired start-up burners are applied.

However, the handling of such separate start-up burners is complicated. It is therefore an object of the invention to provide a method for starting up a gasification process which makes the use of separate start-up burners (ignition burners) superfluous.

It is another object of the invention to provide a simpler, faster and safer operation of gasification processes than can be obtained by means of conventional separate start-up burners.

SUMMARY OF THE INVENTION

The invention therefore provides a method for starting up a partial combustion process, using a burner, wherein finely divided carbon-containing fuel is supplied to a reactor or gasifier and an oxygen-containing gas is supplied separately from the said fuel to the reactor or gasifier and is mixed with the said fuel adjacent the outlet of the burner in the reactor or gasifier, comprising the step of supplying under appropriate process conditions during a predetermined period a low rank or impregnated-particulate carbon-containing fuel to the reactor prior to the start of the partial combustion process, said low rank fuel spontaneously reacting with oxygen when brought into contact with the said oxygen-containing gas, and subsequently switching the burner to a less reactive feed.

DESCRIPTION OF PREFERRED EMBODIMENTS

The present invention makes a favorable use of the spontaneous combustion of low rank particulate carbon containing fuel in oxygen and in particular the high reactivity of particulate low rank coal/oxygen mixtures. Suitable fuels are wood or dry peat.

Further, particulate low rank coal such as dried brown coal, brown coal having a relatively low moisture content or lignite react spontaneously with oxygen when brought into contact therewith.

An example of impregnated particulate carbon-containing fuel is coal treated with a colloidal iron solution, hydrazine phosphoreous solution and the like.

After the start-up of the gasification process by means of such a spontaneous ignition of the reactants supplied to the reactor or gasifier the burner can be switched to a less reactive feed such as hard coal, coke, char and the like.

The invention will now be described in more detail by way of example by reference to the following Examples.

EXAMPLE I

A quantity of 0.12 kg/s dried particulate brown coal (18% water), 90% of which had a particle size less than 100 μm, was supplied during a period of 1 second to 10 minutes to the reactor with a velocity of 15 m/s at a temperature of 90° C.

The pressure in the reactor was about 10 bar and the oxygen content in the oxygen containing gas supplied to the reactor was above 90%. The quantity of the oxygen containing gas was 0.06 kg/s supplied at a temperature of 200° C. with a velocity of 110 m/s.

EXAMPLE II

A quantity of a self-igniting low rank coal such as brown coal having a moisture content of less than 20% was supplied to the reactor during a period of 1 second to 10 minutes with a velocity of 12 m/s and a temperature of 90° C.

The pressure in the reactor was about 25 bar and the oxygen content in the oxygen containing gas supplied at a temperature of 160° C. with a velocity of 80 m/s to the reactor was above 90%. The quantities of coal and oxygen were the same as in Example I.

EXAMPLE III

A quantity of 0.12 kg/s of self-igniting low rank coal such as lignite wherein at least 90% thereof has a particle size less than 80 μm was supplied to the reactor during a period of 1 second to 10 minutes at a temperature of 90° C. with a velocity of 12 m/s.

The pressure in the reactor was about 10 bar and the oxygen content in the oxygen-containing gas was above 90%. The quantity (0.06 kg/s) of oxygen-containing gas was supplied at a temperature of 150° C. with a velocity of 80 m/s.

The following table represents advantageous ranges of the appropriate process conditions and relevant parameters:

TABLE A

| | Oxygen | Low rank carbon-containing fuel |
|---|---|---|
| Water content | — | 1.5–20% |
| Temperature | 150–250° C. | 90 ° C. |
| Velocity | 80–150 m/s | 10–15 m/s |
| Pressure | 10–25 bar | 10–25 bar |
| Particle size | — | 90% < 90 μm |
| Particle size | — | 80% < 100 μm |
| Period | 1 second to 3 minutes | 1 second to 3 minutes |

Various modifications of the present invention will become apparent to those skilled in the art. Such modifications are intended to fall within the scope of the appended claims.

What is claimed is:

1. A method for starting up a partial combustion process, using a burner in a reaction zone, wherein finely divided carbon-containing fuel is supplied to said reaction zone and an oxygen-containing gas is supplied separately from the said fuel to said reaction zone and is mixed with the said fuel adjacent the outlet of the burner in said reaction zone, which method comprises the step of supplying particulate brown coal having a moisture content less than 20% by weight, and at least 80% by weight of said coal particles having a size less than 100 μm, for a period of time from 1 second to 10 minutes to the said reaction zone prior to the start of the partial combustion process, said low rank or impregnated fuel spontaneously reacting with oxygen when brought into contact with the said oxygen-containing gas, and subsequently switching the burner to a less reactive finely divided carbon-containing fuel.

2. The method as claimed in claim 1 wherein the said low rank fuel is supplied to the reactor or gasifier during a period of 1 second to 3 minutes.

3. The method as in claim 1 wherein the said brown coal is supplied at a velocity of 10–15 m/s.

4. The method as in claim 1 wherein simultaneously with said brown coal oxygen is separately supplied to said reaction zone at a temperature of 150°–250° C. at a pressure of 10–25 bar.

5. The method as in claim 4 wherein said oxygen is supplied at a velocity of 80–150 m/s.

6. The method as in claim 5 wherein said oxygen is supplied for a period of time from 1 second to 3 minutes.

* * * * *